United States Patent [19]

Sawa

[11] Patent Number: 4,647,034

[45] Date of Patent: Mar. 3, 1987

[54] SHEET SORTER

[75] Inventor: Yasuo Sawa, Toyokawa, Japan

[73] Assignee: Minolta Camera Kabushiki Kaisha, Osaka, Japan

[21] Appl. No.: 749,417

[22] Filed: Jun. 27, 1985

[30] Foreign Application Priority Data

Jul. 6, 1984 [JP] Japan ..... 59-102913[U]

[51] Int. Cl.[4] ..... B65H 39/10

[52] U.S. Cl. ..... 271/293; 271/273; 271/294; 271/303; 312/272.5

[58] Field of Search ..... 271/293, 294, 295, 296, 271/287, 302, 303, 273, 274; 312/271, 272.5, 302

[56] References Cited

U.S. PATENT DOCUMENTS

| | | | |
|---|---|---|---|
| 4,299,382 | 11/1981 | Ichikawa | 271/273 |
| 4,332,377 | 6/1982 | DuBois et al. | 271/294 |
| 4,466,608 | 8/1984 | DuBois et al. | 271/293 |
| 4,478,406 | 10/1984 | DuBois | 271/293 |
| 4,512,565 | 4/1985 | Matsumoto et al. | 271/294 |

FOREIGN PATENT DOCUMENTS

| | | | |
|---|---|---|---|
| 0492002 | 4/1953 | Canada | 312/272.5 |

*Primary Examiner*—John J. Love
*Assistant Examiner*—John A. Carroll
*Attorney, Agent, or Firm*—Wenderoth, Lind & Ponack

[57] ABSTRACT

A sheet sorter including: a sheet feed passage having an outlet for feeding sheets one by one and a plurality of bin trays situated adjacent to the outlet for receiving sheets fed from the passage. Each said bin tray has a pair of training pins projecting outward from respective sides of an inlet end. These training pins are vertically guided so that the bin trays are held and stacked in a pile. A pair of Geneva cam wheels are used to shift the bin trays, successively, and simultaneously shift the outlet of the passage. The sheet feed passage is defined between upper and lower units accommodated in a sorter case. The upper unit is raised by opening a cover of the sorter case so that the sheet feed passage is opened and accessible for removing sheets jammed therein.

4 Claims, 5 Drawing Figures

SHEET SORTER

BACKGROUND OF THE INVENTION

1. Field of the Invention

This invention relates to a sheet sorter. More particularly, to a sheet sorter in which printed or typed sheets are fed one by one from a printing or copying machine successively to a plurality of bin trays through a sheet feed passage which is suitably synchronized with the bin trays.

2. Description of the Related Art

A conventional sheet sorter known in the prior art includes a plurality of bin trays situated adjacent to an outlet of a sheet feed passage for supplying printed or copied sheets one by one. The bin trays are stacked in a pile with gaps between adjacent bin trays, and the sheets are fed one by one, to successive bin trays.

To align the outlet of the sheet feed passage successively with the gap between the adjacent bin trays, two solutions have been proposed, i.e., one in which the sheet feed passage is fixed, while the respective bin trays are shifted up and down, successively, as disclosed in, for instance, U.S. Pat. No. 4,512,565, and another in which the sheet feed passage is shiftable up and down, and the bin trays are fixed.

Recently, however, a sheet sorter was proposed in which both the sheet feed passage and the stacked bin trays are shiftable in synchronization with each other, as disclosed in, for instance, U.S. Pat. No. 4,478,406. To attain the mutual movement of both the sheet feed passage and the bin trays, the sheet sorter disclosed in U.S. Pat. No. 4,512,565 employs a pair of cylindrical cams having helical grooves. Each of bin trays has a pair of training pins projected from respective sides of the bin tray at an inlet end thereof in such a manner that the respective pairs of training pins are successively engaged with the helical grooves of the cylindrical cams, to shift the bin trays up or down, and the cylindrical cams are guided vertically to simultaneously shift the sheet feed passage.

However, in this sheet sorter, the mechanism for shifting both the sheet feed passage and bin trays up and down is complicated, since the cylindrical cam must be vertically guided as well as driven via a vertical shaft. In addition, in this sheet sorter the sheet feed passage has no opening mechanism to enable the clearing of a possible sheet jamming.

To remove a sheet jammed in the sheet feed passage, a sheet sorter disclosed in the above mentioned U.S. Pat. No. 4,512,565 is provided with means for turning the bin trays in the horizontal direction, making it possible to move the inlet of the bin tray away from the sheet feed passage. In this sheet sorter, however, although it is advantageous in that a possible sheet jamming can be cleared by a simple operation, a relatively wide machine accommodation space is required for horizontally turning the bin trays.

SUMMARY OF THE INVENTION

An object of this invention is to provide a sheet sorter capable of overcoming the disadvantages mentioned above with reference to the related art.

Another object of this invention is to provide a sheet sorter capable of simultaneously shifting both the bin trays and sheet feed passage up and down with a simple structure.

Still another object of this invention is to provide a sheet sorter in which the sheet feed passage can be opened to clear a possible sheet jamming by a simple operation and with less space needed for opening the same.

According to an aspect of the present invention, a sheet sorter is provided comprising: means for defining a sheet feed passage having an outlet for feeding sheets one by one; a plurality of bin trays situated adjacent to the outlet for receiving sheets fed from the passage, each bin tray having a pair of training pins ("tranions") projecting outward from respective sides of an inlet end thereof; a pair of parallel guide means for vertically guiding the pairs of training pins of the bin trays, respectively, so that the bin trays are held and stacked in a pile; a Geneva cam wheel rotatably carried on the passage defining means, the cam wheel having a circular periphery and at least one cam recess on that periphery; means for vertically guiding the cam wheel so that the circular periphery is in contact with the training pins of adjacent bin trays so as to widen a gap therebetween and, when the cam wheel is rotated, the cam recess comes into engagement with the training pins of one of the adjacent bin trays to shift one bin tray up or down, so that the passage defining means as well as the widened gap are simultaneously shifted down or up, respectively, due to the force of gravity acting on the passage defining means, so as to align the outlet of the passage successively with the widened gap.

According to the another aspect of the present invention there is provided a sheet sorter comprising a sorter case; upper and lower units accommodated in the sorter case for defining therebetween a sheet feed passage having an outlet for feeding sheets one by one in a predetermined direction; a plurality of bin trays situated adjacent to the outlet and stacked in a pile with gaps between the adjacent bin trays for receiving sheets fed from the passage; means for widening the gaps, successively, at least at an inlet side of the bin trays; means for shifting the upper and lower units up and down synchronously with the widening means so as to align the outlet of the sheet feed passage with the widened gap; and a cover pivotably mounted on the sorter case about a pivot at an outlet side of the sorter case, the cover having means for guiding the upper unit in the vicinity of its inlet end, the guiding means allowing the upper unit to slide horizontally at its inlet side, when the cover closes the sorter case, and bringing up the upper unit away from the lower unit to open the sheet feed passage when the cover is pivotably opened.

DESCRIPTION OF THE PREFERRED EMBODIMENT

Figure 1:
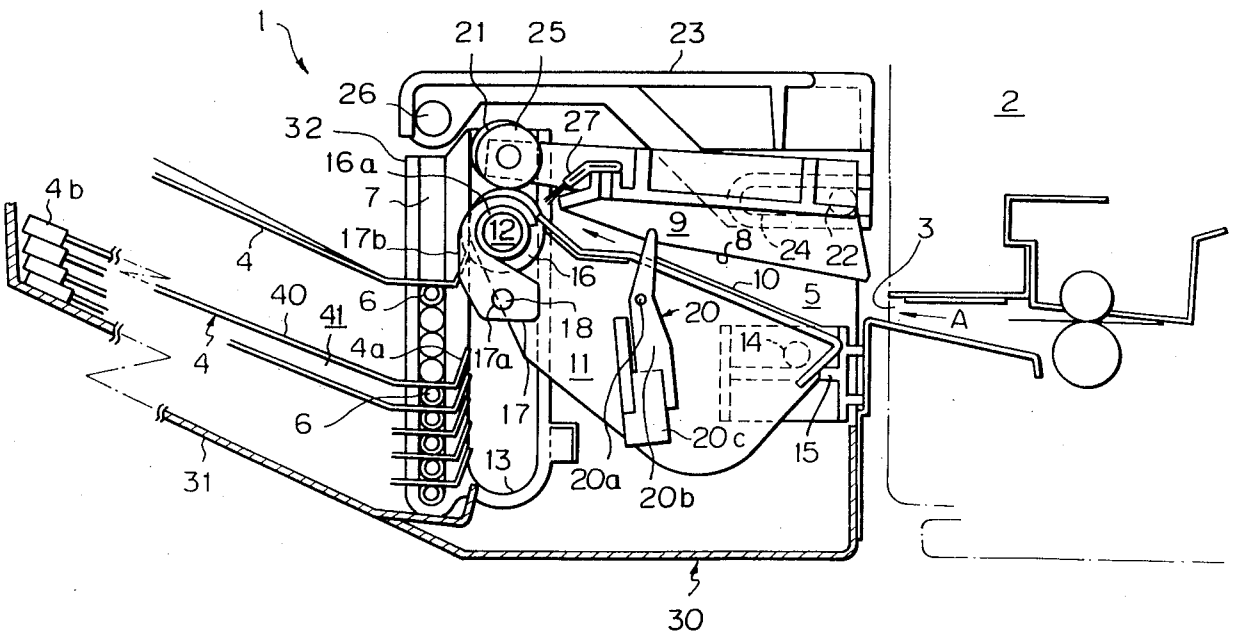
FIG. 1 is a schematic longitudinal elevational view of a sheet sorter according to the present invention.

Referring to FIG. 1, according to the present invention a sheet sorter generally designated by reference numeral 1 is adapted to be located adjacent to an outlet 3 of a suitable copying or printing machine 2. Copied or printed sheets are discharged one by one from the outlet 3 as shown by the arrow A and then, supplied through a sheet passage 5 in a sheet sorter case 30 successively to a plurality of bin member or trays 4. The bin trays 4 and the sheet passage 5 are adapted to shift up and down, as will be described in detail hereinafter.

Figure 2:
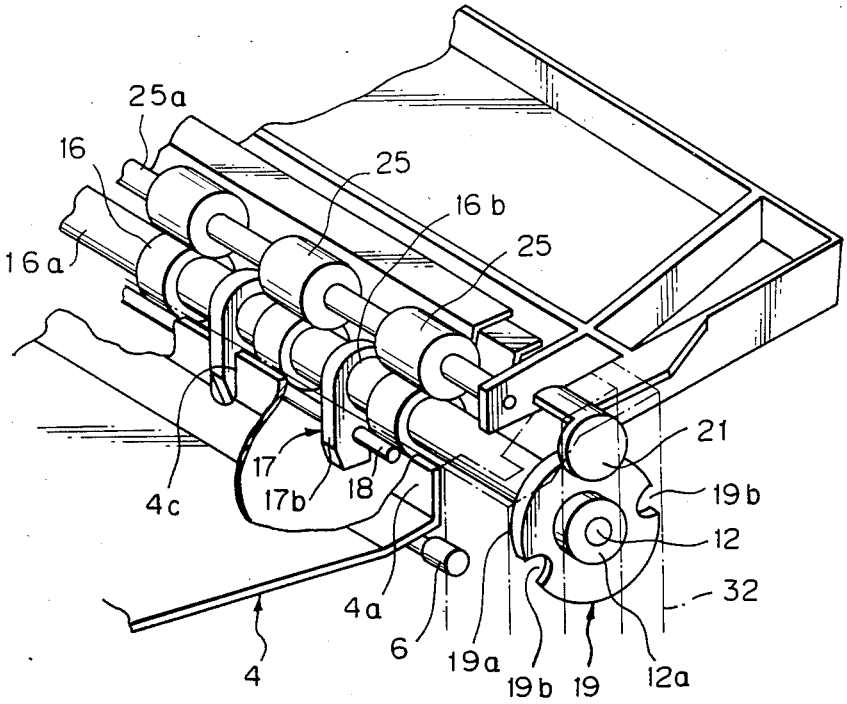
FIG. 2 is a perspective view of a sheet feeding portion of the sheet sorter according to the present invention.

In FIGS. 1 and 2, each of the bin trays 4 has an upward inclined face 40 for supporting thereon a sheet or sheets, a transverse upright edge 4*a* bent upward at an inlet end of the bin tray 4 for holding or stopping the rear edge of a sheet, a pair of training pins ("trunions") 6 projecting transversely outward from the respective side edges at the inlet end of the bin tray 4, and a transverse spacer 4*b* attached to the other end of the bin tray 4.

These bin trays 4 are stacked in a pile at the downstream side of the sheet passage 5 of the sorter 1 in such a manner that each of the trunions 6 is engaged with and vertically guided by a vertical slot 7 of a guide plate 32 fixed to each of the respective side walls of the sheet sorter case 30. These trunions 6 are vertically arranged in line in the vertical slot 7 and in contact with the adjacent trunions 6. The bin trays 4 are accommodated in a bin case 31 attached to the sheet sorter case 30 and are overlapped with each other at the spacers 4*b* in a spacer-to-spacer relationship. Thus, gaps 41 are defined between the respective adjacent bin trays 4 for inserting sheets thereinto.

Figure 3:
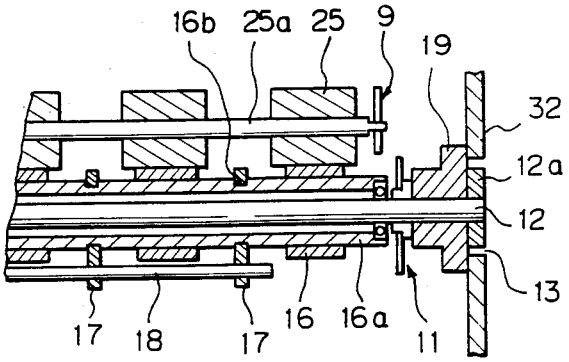
FIG. 3 is a cross-sectional view taken along the roller shafts when seen from above.

In the sheet sorter case 30, an upper unit 9 having a lower sheet guide face 8 and a lower unit 11 having an upper guide face 10 are provided in such a manner that the above-mentioned sheet passage 5 is defined between these sheet guide faces 8 and 10. The lower unit 11 has a pair of pins 14 projecting transversly outward from the respective side edges thereof at the inlet end of the sheet passages adjacent to the outlet 3 of the machine 2. Each of the pins 14 is slidably supported on a horizontal pin guide 15 fixed to the respective side walls of the sheet sorter case 30. At the respective ends of the horizontal guide 15, stoppers 15*a* are provided to limit the sliding movement of the pin 14. The lower unit 11 is provided, at the outlet end thereof, with a transverse shaft 12 rotatably mounted thereon and extending perpendicular to the sheet feeding direction. As shown in FIGS. 2 and 3, a pair of collars 12*a* are rotatably mounted on the respective ends of the shaft 12. Each of the collars 12*a* is engaged with and vertically guided by a vertical U-shaped rail 13 of the guide plate 32 arranged in parallel and adjacent to the vertical slot 7 at an upstream side of the vertical slot 7. Accordingly, the lower unit 11 is supported on the sheet sorter case 30 in such a manner that it is vertically movable at the outlet end of the sheet sorter 1 at the collars 12*a* and also horizontally movable at the inlet end of the sheet sorter 1 at the pins 14.

As shown in FIGS. 2 and 3, a hollow cylindrical roller shaft 16*a* is rotatably and coaxially mounted on the above-mentioned shaft 12. This roller shaft 16*a* has a plurality of rollers 16 fixed thereto and spaced from each other in the axial direction. The roller shaft 16*a* is also provided with a plurality of swing plates 17, each arranged between the adjacent rollers 16 and rotatably or swingably suspended from the roller shaft 16*a*.

Each of the swing plates 17 extends perpendicular to the roller shaft 16*a* and includes a substantially U-shaped upper portion which is rotatably engaged with each of the annular grooves 16*b* (FIG. 3) on the hollow roller shaft 16*a* to suspend the swing plate 17 therefrom, as shown in FIG. 1. The upper portion of the swing plate 17 does not project over the upper configuration of the rollers 16, when viewed in the transverse direction, and thus does not disturb the sheet feeding. A lower portion of this swing plate 17 serves as a mass for maintaining the position of this swing plate 17 due to the force of gravity, and is provided with a slot 17*a* through which a rod 18 passes to connect the swing plates 17 in such a manner so that the plurality of swing plates 17 are integrally swingable around the roller shaft 16*a*. A downstream portion 17*b* of the swing plate 17 at the left side in FIG. 1 is smoothly continued from the upper portion thereof and slightly projected over the configuration of the feed rollers 16, viewed from the transverse direction, to extend toward the bin tray 4 now in operation. The transverse edge 4*a* of the bin tray 4 is provided with a plurality of openings or notches 4*c* to allow the swing movement of the swing plates 17, as shown in FIG. 2.

Figure 4:
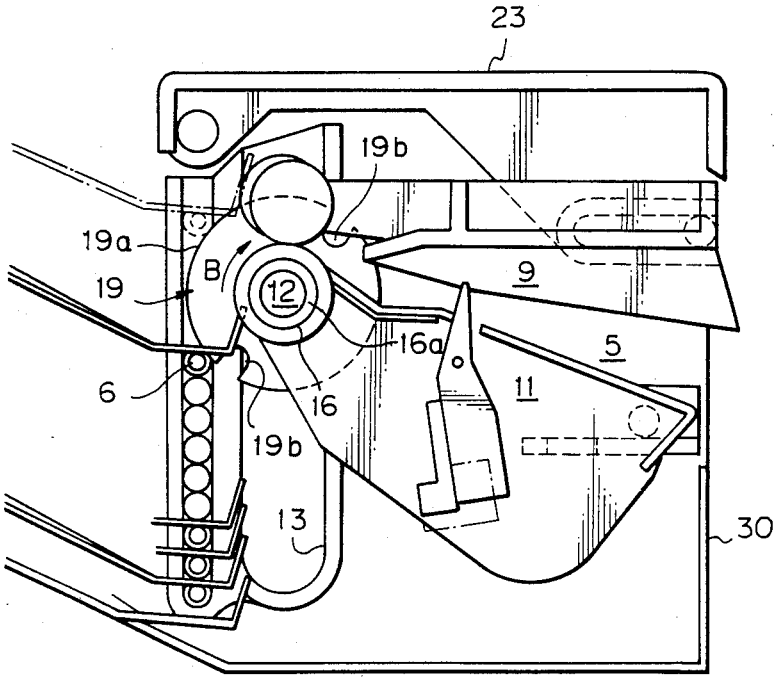
FIG. 4 is a schematic view illustrating mechanisms for shifting both a sheet feed passage and bin trays up and down.

The transverse shaft 12 is provided at the respective ends thereof with Geneva cam wheels 19 rigidly secured thereto, as shown in FIGS. 2, 3 and 4. Each of the cam wheels 19 comprises a circular cam periphery 19*a* and two recesses 19*b* formed on the periphery of the cam and diametrically opposed to each other. A part of the circular periphery 19*a* is positioned on a path parallel to the vertical slot 7 as shown in FIG. 4 in such a manner that it is in contact with the trunions 6 of the adjacent bin trays 4 to widen the gap 41*a* therebetween. In this way, the lower unit 11 is supported on the trunions 6 vertically arranged in the slot 7 via the cam wheels 19. When the cam wheel 19 is rotated in the direction shown by the arrow B in FIG. 4, the recesses 19*b* are successively brought into engagement with the trunions 6 of the bin trays 4, thus shifting the bin trays 4 up one by one, from a lower position to an upper position to form a widened gap between adjacent trays. When the cam wheel 19 is rotated in the opposite direction, the bin trays are lowered, one by one, from the upper position to the lower position to form the widened gap, in a similar manner.

The shaft 12 of the Geneva cam 19 and the feed roller shaft 16*a* are driven independently by any suitable drive means (not shown) mounted on the lower unit 11. A sheet detecting device 20 is mounted on the lower unit 11. The sheet detecting device 20 comprises an actuator 20*b* rotatably or pivotably mounted on the lower unit 11 by a pivot 20*a*, and a photo sensor 20*c*. If a sheet exists in the passage 5, the actuator 20*b* is pivotably moved, in the counterclockwise direction in FIG. 1, about the pivot 20*a* so that an optical path is opened for the photo sensor 20*c*.

The upper unit 9 has a pair of pins 22 projecting transversely outward from the respective side edges thereof at the inlet end of the sheet feed passage 5 adjacent to the outlet 3 of the machine 2. Each of the pins 22 is slidably supported on a U-shaped horizontal pin guide 24 fixed to each of the respective side walls of a sorter cover 23, which is pivotably mounted on the sheet sorter case 30 at a pivot shaft 26. At the outlet end of the sheet feed passage 5, the upper unit 9 is provided with a pair of engaging members 21 projecting from the respective side frames thereof. The members 21 are engaged with the above-mentioned respective U-shaped rails 13 in such a manner that they are movable in the vertical direction. Therefore, the upper unit 9 is also supported on the sheet sorter case 30 in such a manner that it is movable vertically at the outlet end of the sheet feed passage 5 at the engaging members 21 and horizontally movable at the inlet end of the sheet feed passage 5 at the pins 22.

As shown in FIG. 2, the upper unit 9 is also provided with a plurality of pinch rollers 25 rotatably mounted on a transverse pinch roller shaft 25*a* extending perpendicular to the sheet feeding direction and arranged inside the engaging members 21 in such a manner that the pinch rollers 25 are in contact with the respective feed rollers 16. Due to the action of gravity on the upper unit 9, the respective pinch rollers 25 are urged against the corresponding feed rollers 16 to define a sheet feeding path therebetween.

As mentioned above, the sorter cover 23 is pivotably mounted on the sheet sorter case 30 about the shaft 26 provided at the outlet side of the sheet passage 5, so that the sorter case 30 can be opened or closed by the cover 23 and the upper unit 9 can also follow the movement of the sorter cover 23, to open the sheet feed passage 5 and allow access thereto.

The upper unit 9 is also provided with an electrostatic cleaner 27 projecting into the sheet passage 5 for removing electrostatic charge from the sheet being fed.

In a sheet sorter 1 as mentioned above, when the Geneva cam wheel 19 rotates in the direction shown by the arrow B in FIG. 4, the lower trunion 6 now in contact with the circular periphery 19*a* is caught by one of the recesses 19*b* and shifted to the upper position of the widened gap, as mentioned above, and at the same time, the Geneva cam wheel 19 moves downward to come into contact with the training pin 6 of the next bin tray 4. As this operation is repeated, the bin members 4 are shifted up, one by one, and the widened gaps between the adjacent bin trays 4 and the sheet feed passage 5 are synchronously moved downward.

When the Geneva cam wheel 19 rotates in the opposite direction, the bin trays 4 are shifted down, one by one, and the widened gaps between the adjacent bin trays 4 and the sheet feed passage 5 are synchronously moved upward.

The printed or copied sheets are discharged, one by one, from the outlet 3 of the copying or printing machine 2 and supplied as shown by arrow A in FIG. 1 into the sheet feed passage 5 of the sheet sorter 1. When the front end of the sheet comes into contact with and pivotably moves the actuator 20*b* of the sheet detector 20, the photo sensor 20*c* detects the presence of the sheet and inputs a signal to that effect to a suitable control unit (not shown) so that the pair of Geneva cam wheels 19 rotate by 180° in either direction. Therefore, a widened gap between adjacent bin trays 4 into which the sheet is to be inserted is prepared as mentioned above.

The sheet is then caught by the feed rollers 16 and pinch rollers 25 and forcibly fed into the widened gap between the above mentioned adjacent bin trays. After being released from the pressure between the rollers 16 and 25, the rear end of the sheet falls onto the bin tray 4, while sliding along the downstream portion 17*b* of each swing plate 17.

Even if the sheet fails to be placed properly on the bin tray 4, due to electrostatic charge on the sheet or for another reason, the rear end of sheet is prevented from being rolled up to the feed rollers 16, because of the presence of the swing plates 17 between the transverse edge 4*a* of the bin tray 4 and the feed rollers 16. In addition, the swing plates 17 are swung around the feed roller shaft 16*a* by the rotation of the feed rollers 16, so that the swing plates 17 tap the rear edge of the sheet and put it in order without trapping the rear end of the sheet. After the sheet is received in the bin tray 4, the next sheets coming through the sheet feed passage 5 are accommodated in the next upper or lower bin trays 4 successively.

Figure 5:
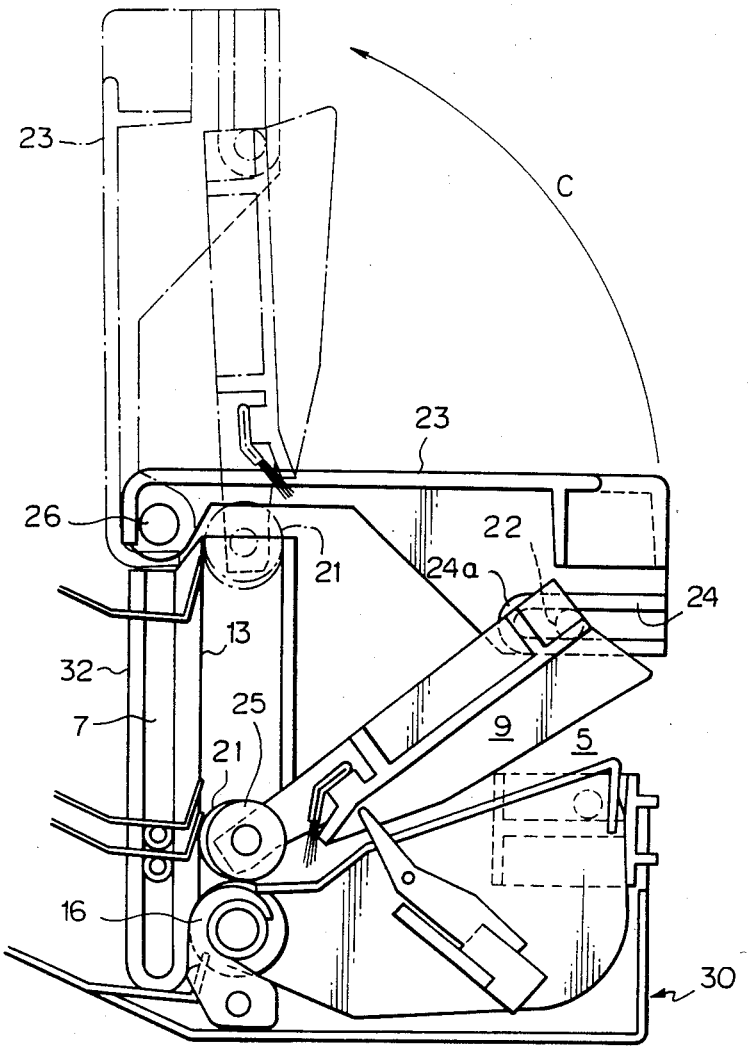
FIG. 5 is a schematic view illustrating a mechanism for opening the sheet feed passage to enable access thereto when removing a jammed sheet.

In FIG. 5, when the sorter cover 23 is raised about the pivot shaft 26 in the direction shown by the arrow C, the pin 22 of the upper unit 9 first slides along the U-shaped pin guide 24 and then comes into contact with the bottom portion 24*a* thereof. If the sorter cover 23 is further raised, the engaging member 21 of the upper unit 9 moves upward along the vertical rail 13 and the upper unit 9 is raised, as shown in FIG. 5. Therefore, with a single operation of raising the sorter cover 23, the sheet passage 5 is opened and accessible, and at the same time, the pinch rollers 25 come away from the feed rollers 16 to widen the gap of the passage area between the bin trays 4 and sheet feed passage 5 in the sheet sorter body 30 adjacent to the bin trays 4. Therefore, any sheets jammed therein can be easily removed from the sheet feed passage 5 and from the feed area around the rollers 16 and 25.

I claim:

1. A sheet sorter comprising a sorter case;

an upper and lower units accommodated in said sorter case for defining therebetween a sheet feed passage having an outlet for feeding sheets one by one in a predetermined direction;

a plurality of bin trays situated adjacent to said outlet and stacked in a pile with gaps between the adjacent bin trays for receiving sheets fed from said passage;

means for widening said gaps, successively, at least at an inlet side of the bin trays;

means for synchronously shifting said upper and lower units up and down with said widening means so as to align said outlet of the sheet feed passage with the widened gap; and an upper cover pivotably mounted on said sorter case about a pivot point at an outlet side of the case, said upper cover having means for guiding said upper unit into the vicinity of its inlet end, said guiding means allowing said upper unit to horizontally slide at its inlet side, when the cover closes the sorter case, and bringing up said upper unit away from said lower unit to open said sheet feed passage when said cover is pivotably opened.

2. A sheet sorter as set forth in claim 1, wherein said lower unit rotatably carries feed rollers adjacent to said outlet of the passage, and said upper unit rotatably carries pinch rollers adjacent to said outlet of the passage; and said sorter comprises means for vertically guiding said feed rollers and pinch rollers so that said pinch rollers are in contact with said feed rollers to define therebetween a positive feeding portion of said sheet feed passage.

3. A sheet sorter as set forth in claim 2, wherein said means for guiding the upper unit in the vicinity of its inlet end comprises a U-shaped horizontal guide slot closed at the downstream side of the cover, and said upper unit has at its inlet side a pin engaging with said guide slot, so that said upper unit is horizontally slidable at its inlet side when the cover is closed, while said upper unit is brought up and away from said lower unit, and said pin engages with said closed end of the guide slot when the cover is opened.

4. A sheet sorter as set forth in claim 1, wherein said sorter case has means for horizontally guiding said lower unit at its inlet end.

* * * * *